United States Patent [19]

Crosby et al.

[11] 4,427,541

[45] Jan. 24, 1984

[54] METHOD AND APPARATUS FOR SPRAY FRACTIONATION OF PARTICLES IN LIQUID SUSPENSION

[75] Inventors: Edwin J. Crosby, Madison, Wis.; Anil R. Oroskar, Downers Grove, Ill.

[73] Assignee: Wisconsin Alumni Research Foundation, Madison, Wis.

[21] Appl. No.: 372,511

[22] Filed: Apr. 28, 1982

[51] Int. Cl.[3] ..... B03B 5/00; D21D 5/22

[52] U.S. Cl. ..... 209/210; 209/148

[58] Field of Search ..... 209/210, 145, 143, 207, 209/139 A, 148, 695, 642; 494/85

[56] References Cited

U.S. PATENT DOCUMENTS

| | | | |
|---|---|---|---|
| 472,682 | 4/1892 | Pape et al. | 209/148 X |
| 1,358,375 | 11/1920 | Koch | 209/145 |
| 1,517,509 | 12/1924 | Hokanson | 209/148 X |
| 2,224,169 | 12/1940 | Turnbull | 209/145 X |
| 3,326,459 | 6/1967 | Leroux | 209/210 |
| 3,591,000 | 7/1971 | Humphreys | 209/210 |
| 3,819,110 | 6/1974 | Baturov et al. | 209/210 |
| 4,288,317 | 9/1981 | de Ruvo et al. | 209/139 A |

OTHER PUBLICATIONS

Felsvang et al., Screening, Cleaning and Fractionation with a Rotating Cup Atomizer, 17th EUCEPA Conf., Vienna, Oct., 10–14, 1977.

Moller et al., "Screening, Cleaning and Fractionation, with an Atomizer", Paper Technology and Industry, vol. 20 (3), pp. 110–114, Apr. 1979.

Moller et al., "High Consistency Pulp Fractionation with an Atomizer", Tappi, vol. 63 (9), pp. 89–91, Sep. 1980.

*Primary Examiner*—Ralph J. Hill

*Attorney, Agent, or Firm*—Howard W. Bremer; Harry C. Engstrom

[57] ABSTRACT

Fractionation apparatus (20) is disclosed which utilizes a rapidily rotating disk which receives a liquid suspension of particles to be separated onto its rotating face surface (35). When the film of liquid and particles on the rotating face surface (35) reaches the peripheral edge (38) of the face, particles above a certain size are radially ejected while smaller particles and the liquid are carried over the edge onto the surface of a depending rim (39). The suspension of smaller particles and liquid is carried down the rim to the rim edge (40) at which point the smaller particles and liquid are disengaged. A separator wall (27) may be interposed between the two streams of particles emanating from the disk (24) to provide a physical separation of the larger and smaller particles once they have left the disk. The characteristics of the face surface, the angle of the rim with respect to the face, the disk speed, suspension feed rate, and other operating conditions can be selected such that highly efficient fractionations of particle suspensions, such as wood pulp slurries, can be obtained about a selected break point particle size.

28 Claims, 11 Drawing Figures

METHOD AND APPARATUS FOR SPRAY FRACTIONATION OF PARTICLES IN LIQUID SUSPENSION

TECHNICAL FIELD

This invention relates generally to the field of apparatus and techniques for separating particles within a liquid carrier, such as fibers in a pulp slurry, according to the relative sizes of the particles.

BACKGROUND ART

Processes for separating small particles contained in a suspension or slurry by size find application in various industries. The ability to make such separations is particularly desirable in paper making since the thickness and length of the pulp fibers are strongly related to the quality and characteristics of the paper produced from the fibers. Several specific potential uses in the paper industry for efficient fractionation processes have been identified.

A pulp slurry formed of reclaimed waste paper or paperboard could be fractionated to remove clumps and particular contaminants, and to separate fibers above and below a desired size. For example, such fractionation would allow the "linerboard" fibers in a slurry of waste corrugated fiberboard to be separated from the "medium" fibers. Linerboard is mainly composed of softwood fibers of relatively large size (40–50 microns diameter, 3–5 mm length) whereas medium fibers are mainly hardwood fibers of smaller size (20–30 microns diameter, 1–3 mm length).

Fractionation would also allow a single fiber source, which ordinarily is a mix of fibers of various sizes, to be used optimally in the production of a desired multilayered product. Each fraction, separated by fiber size, could be used to form a single layer which would have characteristics reflecting the size of the fibers in the layer. The layers of different fractions would then be combined to form a multilayered product with qualities not possessed by a single layer product formed from the original fiber mix.

The separated pulp fractions could also be used alone to make single layer products having desired characteristics related to fiber size. In addition, some papermaking machines operate most efficiently with pulp having a particular fiber size range. Another potential application of pulp fractionation is the separation of a pulp stream into two or more fractions which can be beaten separately under optimum conditions and then recombined.

Although the potential applications of pulp fractionation are well known, fractionation has not been commercially important because of the lack of efficient equipment. Commercial equipment capable of pulp fractionation, e.g., centrifugal screens and the Johnson Fractionator, generally suffer from high energy consumption, a requirement for low pulp concentration (1% or less), and potential water pollution problems if operated on a large scale.

In addition to the commercially available fractionation processes, it has been found that if a pulp slurry is fed to the underside of a conventional, commercially available, rotating disk atomizer of inverted saucer geometry, the resulting spray will show a variation, as a function of vertical position, in the average size of the granular and fibrous particles in the spray. See, e.g., K. Moller, et al., "Screening, Cleaning and Fractionation with an Atomizer," Paper Technology and Industry, Vol. 20, No. 3, pp. 110–114, April, 1979, which also proposes two physical mechanisms to explain the fractionation phenomenon. First, a high shear gradient is assumed to exist in the pulp film on the atomized wheel. The portion of the pulp suspension near the wheel surface would be accelerated more quickly than the portion of the suspension near the free surface of the film. The high shear gradients near the wheel surface cause the larger particles to migrate away from the immediate vicinity of the wheel surface while the fine material stays behind. Another mechanism proposed for the fractionation is based on the centrifugal force experienced by the film as it moves over the surface of the inverted, saucer shaped atomizer disk. This force serves to keep the film, as a whole, pressed hard against the atomizer surface and thereby maximizes acceleration. The centrifugal force is presumed to cause the larger, denser particles or fibers to migrate inwards from the free surface of the film toward the surface of the wheel with the smaller particles or fines remaining behind.

Fractionation tests in which the particle slurry is fed to the underside of an atomizer wheel show that the concentration of smaller particles in the spray surrounding the wheel increases gradually with increasing height while the concentration of larger particles decreases. Thus, by collecting a portion of the spray at a selected position in the spray, it is possible to obtain a particle mix which has a higher percentage of particles of a certain size than does the feed stock. However, because of the apparent gradual change in particle size as a function of vertical position around the atomizer wheel, commercial atomizer equipment does not provide efficient fractionation and generally cannot be used to obtain a fractionated product which contains only particles within a specified size range or which is free of particles in a specified size range.

DISCLOSURE OF THE INVENTION

In accordance with the present invention, highly efficient fractionations of particle suspensions are obtained utilizing a rotating disk which is constructed to best accommodate the phenomena responsible for such fractionation. Under proper conditions, a suspension of particles of mixed sizes can be split into two discrete portions containing particles only larger or smaller than a chosen size. Higher fractionation efficiencies can thus be obtained than are possible with commercial fractionators or atomizer equipment used for fractionation.

The disk is symmetrical about an axis of rotation and has a face, adapted to stabilize the film of the slurry deposited on the face, which terminates in a sharp, circular, peripheral edge. A depending rim extends from the face edge and terminates in a peripheral rim edge. The design of the rim and the edge at which it meets the face are critical to the fractionation process. The rim must extend away from the face edge at an angle of 90° or less with respect to horizontal, if the disk is rotated about a vertical axis, the rim must be wettable by the suspension slurry, and the length of the rim edge must be sufficient to allow a stable film of the suspension to form on it. When such a disk is rotated and supplied with a particulate slurry to its face, a distinct separation of coarse particles and fines as a function of elevation will occur in the spray surrounding the disk. The coarse particles are found to detach themselves from the flowing slurry film in a dewatered state and to move radially from the face edge in a relatively narrow band, while the fines are carried by the flowing liquid film over the surface of the rim and disengage, with the film, along the rim or at the rim edge. The separation takes place in apparent correlation with particle diameter for elongated particles, such as wood fibers, resulting in separations of 95% or better of particles above a selected diameter from particles below the selected diameter. Such discrimination in particle size allows separation of fibers by length, if fiber length is directly related to fiber diameter, as is generally the case for wood pulp. In particular, clumps of large fibers, shives, and foreign particles, such as sand, are almost completely separated from the fine particles in such wood pulp slurries.

In the present invention, the separation of the fine from coarse particles is an effect related to the wettability of the surfaces of the disk, particularly of the rim of the disk, the wettability of solid particles within the film, the surface tension of the film, and the centrifugal acceleration force at the rim. The larger, coarse particles apparently can break free from the film at the sharp face edge under proper conditions of feed rate and disk rotational speed, whereas the smaller particles apparently remain entrapped within the film as it flows over the face edge onto the rim. A separator plate may thus be positioned adjacent the rim to physically separate the two streams of spray impelled from the disk, one carrying the coarse particles and the other the fines. Because the separation takes place at the edge of the disk, drafts of auxilliary air adjacent the disk serve no purpose and are preferably avoided.

In preferred apparatus for carrying out the invention, the rotating disk has a face surface adapted to stabilize the flowing film, such as a flat, smooth, horizontal surface. The rim extends away from the sharp face edge at an angle between about 90° and 20° to a horizontal plane where the disk rotates about a vertical axis. By selecting the diameter and rotational speed of the disk, the length of the rim and its angle with respect to the face surface, and the pulp slurry feed rate and concentration, it is possible to split a pulp slurry into two components above or below any chosen fiber diameter in the range of 10 microns to 200 microns, corresponding to typical fiber lengths in the range of 1 mm to 10 mm. By successive passes of a fiber furnish through an apparatus of the type described, it is possible to separate an initial fiber furnish into components which contain substantially only fibers within a preselected size range.

Further objects, features and advantages of the invention will be apparent from the following detailed description taken in conjunction with the accompanying drawings showing a preferred embodiment of apparatus for carrying out spray fractionation in accordance with the invention.

BEST MODE FOR CARRYING OUT THE INVENTION

Figure 1:
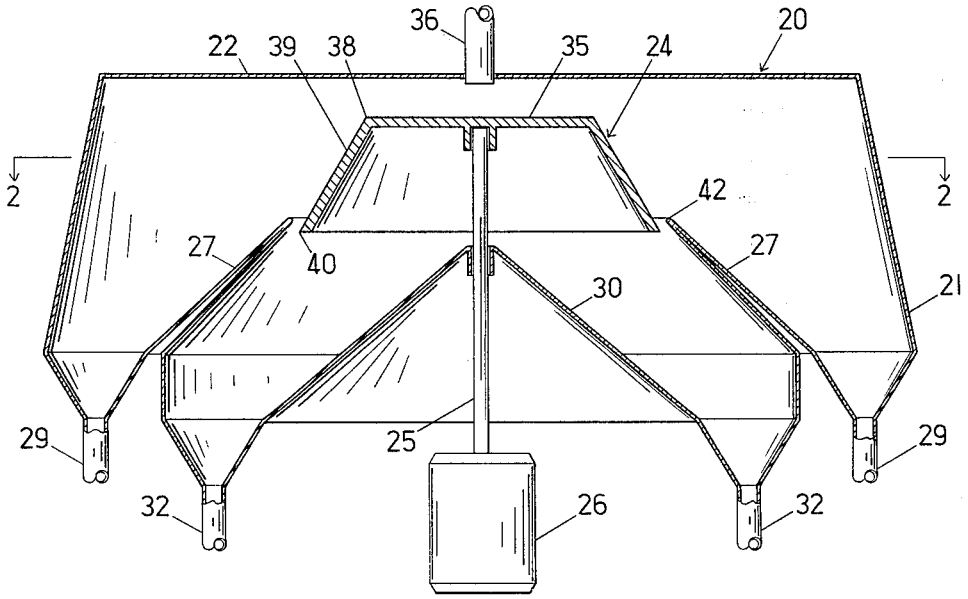
FIG. 1 is a simplified cross-sectional view of a spray collector chamber enclosure with a rotating disk mounted within.
Figure 2:
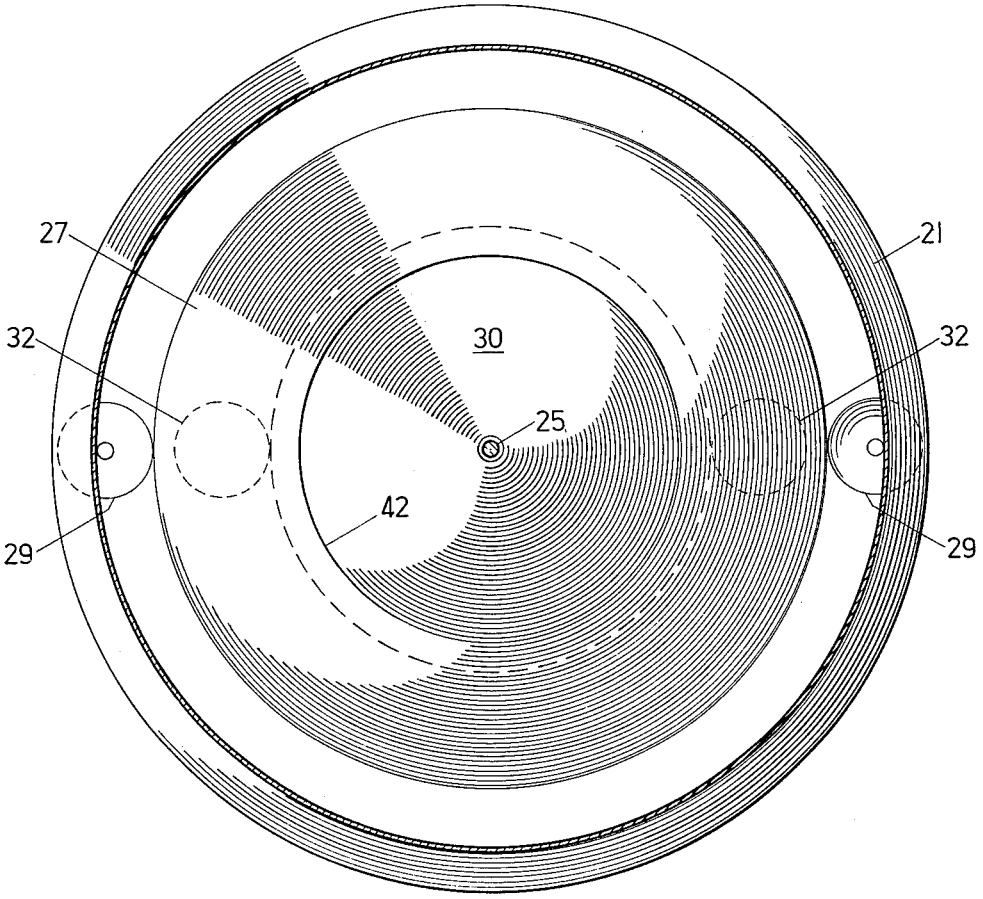
FIG. 2 is a cross-sectional view of the spray collector chamber taken along the line 2—2 of FIG. 1 with the rotating disk removed.

With reference to the drawings, a simplified cross-sectional view of fractionation apparatus in accordance with the invention is shown generally at 20 in FIG. 1. A generally cylindrical outer enclosure wall 21 and a top enclosure wall 22 surround and close off from the atmosphere a fractionation disk 24 which is mounted for rotation about a vertical axis on a shaft 25 driven by an electric motor 26. The disk 24 is symmetrical about the axis on which it rotates. A truncated cone shaped separator wall 27 is mounted within the collector defined by the walls 21 and 22 to separate the collector into two chambers. The first chamber, defined between the separator wall 27 and the outer wall 21, collects larger, dewatered fibers, which are discharged through outlet pipes 29. The second lower chamber or sump, defined between the separator wall 27 and a conical deflector wall 30, collects the smaller fibers along with most of the water. The water and fiber slurry collected in the sump is drained out through sump outlet pipes 32.

The feedstock, a suspension or slurry of particles in water or other liquid, is supplied to the center of the face 35 of the disk 24 through a supply outlet 36 which discharges the slurry just above the center of the face. The face 35 is formed on the side of the disk opposite that to which the shaft 25 is attached, so that the face surface is not interrupted by any mechanical connections which would be necessary if the mounting of the disk were made to the face. For reasons explained further below, it is desirable for the face to be as well adapted as possible to allow a stable film of liquid to form thereon. The feedstock is pumped to the supply outlet from a tank using standard equipment (not shown). As explained further below, the suspension of particles in liquid forms a film on the rotating face surface 35 which moves to the peripheral face edge 38, at which a separation of the larger particles from the smaller particles occurs. The larger particles tend to break the surface of the film at the face edge 38 and are ejected from the disk, while the smaller particles remain in the film which turns over the edge 38 and pass downward along the rim 39 of the disk until the film and particles reach the rim edge 40, where both liquid and particles are ejected. The larger particles are collected in the first collector chamber, between the separator wall 27 and the outer wall 21, and the water and smaller particles are collected in the second collector chamber between the separator wall 27 and the inner wall 30. Because the larger particles within the first chamber will have very little water associated with them, it may be desirable under some circumstances to provide a water spray within the first chamber to wash the larger particles down into the outlets 29. To obtain the best separation of the larger particles from the smaller particles, it is preferred that the inner edge 42 of the separator wall 27 be positioned closely adjacent the rim and intermediate the vertical positions of the face edge 38 and the rim edge 40 so that the water and smaller particles will pass underneath the separator wall 27 while substantially all of the larger particles will be ejected above and will fall on or beyond the wall 27.

Figure 3:
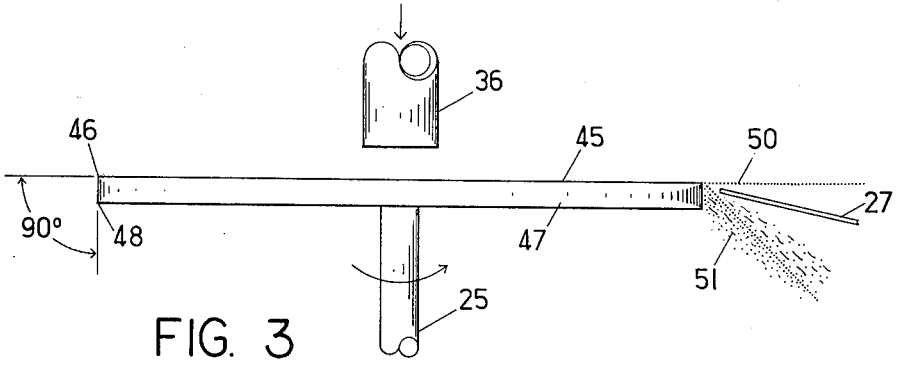
FIG. 3 is a side elevation view of a disk utilized in the apparatus of the invention.
Figure 4:
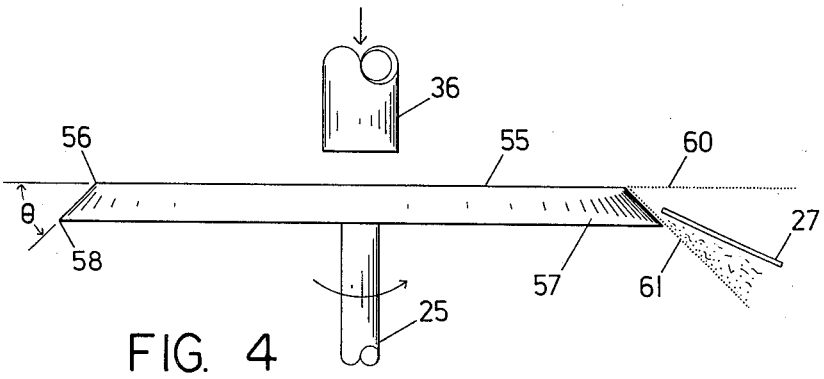
FIG. 4 is an embodiment of a disk having a beveled rim.
Figure 5:
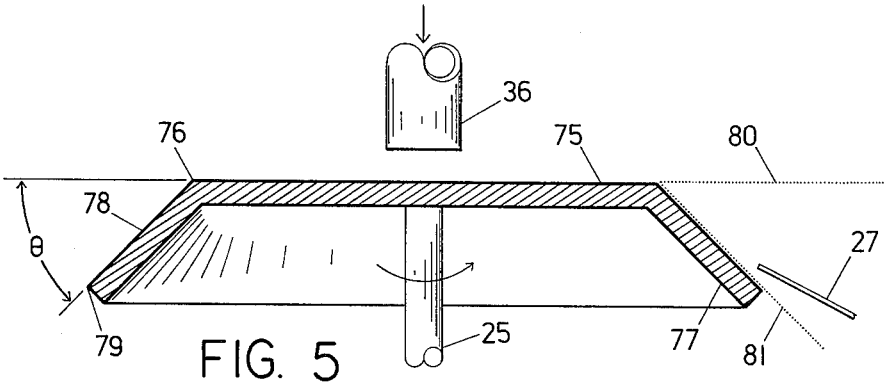
FIG. 5 is another embodiment of a disk having an extended rim.

More detailed views of various embodiments of the rotating disk used in the spray fractionation apparatus 20 are shown in FIGS. 3–5, it being understood that each of the embodiments shown in these figures may be substituted for the disk 24 illustrated in FIG. 1.

The disk shown in FIG. 3 has a substantially flat, circular face surface 45, a sharp, circular face edge 46 which bounds the face 45, and a smooth, cylindrical rim 47 which extends downwardly from the edge 46 at a 90° angle to the horizontal plane of the face surface 45. The rim 47 terminates in a rim edge 48. The disk can be formed of aluminum or suitable grades of steel (preferably stainless) with the surfaces of the face 45 and the rim 47 being polished to assure maximum wettability of these surfaces by the slurry that is provided through the pipe 36.

It is found that when the disk of FIG. 3 is rotated at a sufficiently high speed, for example, in the range of 3,000 rpm or higher, the fibers contained within the feed stock supplied to the center of the face 45 will split into two distinct streams of spray which have different directions as they exit from the spinning disk. The upper stream of spray illustrated at 50 in FIG. 3 has been found to contain larger diameter fibers and particles, while the lower, downwardly deflected stream illustrated at 51 is found to contain the smaller fibers or fines. A separator wall 27 is shown interposed between the two streams of spray to physically separate them after they have left the disk.

It has been determined as a part of the present invention that the angle at which the rim surface intersects the face surface at the peripheral edge is an important factor in efficient fractionation. This is illustrated with respect to the disk shown in FIG. 4, which has a substantially flat face surface 55 bounded by a circular peripheral face edge 56, and a beveled rim 57 which descends downwardly from the peripheral edge 56 at an angle $\theta$ with respect to the plane of the face surface 55. The beveled rim 57 terminates in a rim edge 58. The disk may be formed such that utilization of a rim angle $\theta$ less than 90° can increase the efficiency of fractionation. Under proper conditions, the larger particles will eject radially from the edge 56 of the disk in a first stream, generally denoted at 60 in FIG. 4, while the smaller particles will remain within the film on the disk, which will turn over the edge 56 and follow the rim 57 to the rim edge 58, whereupon the film and the smaller particles will be ejected in a direction having a downward velocity component in a second stream illustratively denoted at 61 in FIG. 4. The face edge 56 is formed to be relatively "sharp" so that the film undergoes an abrupt change in direction at the face edge. As explained further below, the momentum of the larger particles as they move radially outward from the face edge is sufficient to allow them to overcome the surface tension of the film and thereby fly outwardly from the disk in a radial direction. If the face edge is not sharp, that is, has a relatively large radius of curvature, the change in direction of the film and particles therein will not be abrupt enough to allow the large particles to break free. The "sharpness" of the rim required for efficient fractionation can easily be determined by experiment for any given slurry liquid, feedstock, or particulate concentration. In general, an edge radius of curvature of 10 microns or less will perform adequately for common feedstocks such as pulp slurry, although larger radii of curvation at the edge may be possible under some conditions. The separator wall 27 may be interposed between the streams 60 and 61 to maintain physical separation between the streams as they leave the disk. The disk is preferably formed such that the rim angle $\theta$ at which the rim surface intersects a horizontal plane lies between about 90°, the angle of the disk of FIG. 3, and approximately 20°, although an angle as small as 5° may be used under proper conditions.

For a given disk face diameter and rotational speed, slurry feed rate, and fiber concentration in the feed stock, a rim angle $\theta$ can be found such that nearly all of the particles in the feed stock above a selected diameter eject from the disk in a well defined upper stream, whereas almost all of the particles within the slurry which are below the selected diameter will pass downwardly in a well defined lower stream. A separator, such as the separator wall 27, can then be interposed between the two streams to keep them separated.

From theoretical studies of the action of fibers on a spinning disk, it has been determined that the design conditions required to achieve separation of fibers on the disk above and below a selected fiber diameter D is given by the following equation:

$$\sin\theta \cdot \frac{D^2(\rho_S - \rho_L)\omega^2 r[\ln(L/D) - 0.72]}{8\mu} = \sqrt{\frac{8\gamma}{D\rho_S}}$$

where

D = fiber diameter (cm)
$\rho_s$ = fiber density (gm/cm$^3$)
$\rho_L$ = fluid density (gm/cm$^3$)
$\omega$ = rotational speed of disk (rad/sec)
r = radius of peripheral face edge (cm)
L = fiber length (cm)
$\mu$ = fluid viscosity (gm/cm sec)
$\gamma$ = surface tension (dynes/cm)
$\theta$ = rim angle (rad)

It is noted that fiber length is not a substantial factor in the design equation; it appears only in the term [1n(L/D)−0.72]. This term does not change significantly in magnitude if the length is varied independently of the fiber diameter. Thus, variations in fiber lengths, not accompanied by variations in fiber diameter, will not appreciably affect the fractionation taking place according to fiber diameter.

When given a particular disk design, the rotational speed required to fractionate about a selected diameter D can be expressed by rewriting the equation above as follows:

$$\omega = \sqrt{\frac{8\mu\sqrt{\frac{8\gamma}{D\rho_S}}}{D^2(\rho_S - \rho_L)r\sin\theta[\ln(L/D) - 0.72]}}$$

By using the above equation, the rotational speed can be calculated at which all fibers larger than a selected diameter will disengage from the disk at the face edge, provided that the surry film on the face and the rim is stable at such speed.

Figure 6:
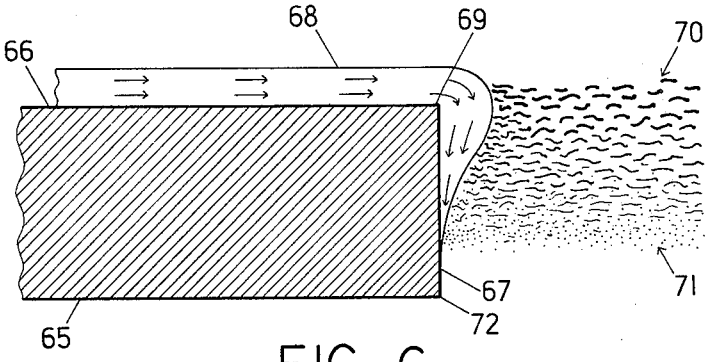
FIG. 6 is a view of a portion of a rotating disk illustratively showing the liquid film turning over the face edge of the disk onto the rim.

The foregoing design equations are derived on the assumption, in part, that the liquid film turns over the peripheral face edge and continues to move as a stable film on the rim. The rim thus must be wettable by the liquid film for, if it is not, the film of liquid, along with all of the particles in it, will be ejected radially outward at the peripheral face edge and will not turn over the edge. With reference to the disk shown in FIG. 4, the necessity of having a wettable rim is confirmed by covering the rim with a silicone grease—thereby drastically decreasing the wettability of the rim surface. Under such conditions, almost no separation of fibers is found in the spray around the disk. Wetting only a portion of the rim, so that the rim is effectively shortened, is found to substantially reduce the amount of fractionation, particularly if less than about $\frac{3}{8}$ inch of rim is left wettable. For a metal disk, and water as the carrying liquid, the rim must generally be at least $\frac{3}{8}$ inch in length, from the face edge to the rim edge, to allow a stable film to form on the rim. Referring to FIG. 6, which shows a disk 65 having a flat face surface 66 and a 90° angle rim 67, for proper fractionation to occur, the liquid film 68 must turn completely over the peripheral face edge 69 and stabilize along the rim surface. The larger particles will break free in the vicinity of the edge 69 because their greater inertia is sufficient to break the force of the surface tension of the film. For a 90° rim angle disk, such as that shown in FIG. 6, the smaller particles will remain with the liquid film which will turn over the corner 69 and move at least part of the way down the rim 67. The centrifugal force on the liquid film, and the smaller particles carried therein, will generally be sufficient to allow most of the film and the particles therein to break away from the rim before the film reaches the rim edge 72 because of instabilities which appear as ripples in the film on the rim. The film and particles which break free from the rim will have a small downward velocity vector component and will be spaced downwardly of the stream of larger particles 70 which breaks free of the film at the face edge 69. If the rim is too small, the film will be very unstable, breaking off in droplets from the face edge, thereby mixing the small particles with the large particles. In addition, a small rim does not provide much initial physical separation of the two streams, thus allowing the streams to mix a short distance from the disk. At certain disk speeds and wettability conditions, the liquid film could move all the way down the rim to the rim edge 72 and would there be ejected from the disk since it could not turn the corner at the rim edge 72. Such conditions allow even more distinct separation of the spray streams carrying the larger and smaller particles.

The length of the rim can be extended by forming the disk as shown in FIG. 5. The disk embodiment shown therein has a flat, circular face surface 75 bounded by a sharp peripheral face edge 76, and a rim 77 which extends downwardly and outwardly from the face 75. The rim has a rim surface 78 which intersects the face surface 75 at the edge 76 at an angle $\theta$. The rim surface 78 terminates in a rim edge 79. In effect, the disk of FIG. 5 is equivalent to the disk of FIG. 4 but is constructed so it can have a rim surface length—the distance between the peripheral edge 76 and the rim edge 79—of any desired length. As an example, the disk of FIG. 5 may have a face diameter of 6 inches and a rim length of 2 inches. The relatively long rim of the disk of FIG. 5 minimizes intermixing of the larger particles and fibers in the upper stream 80 with the smaller particles and the liquid film itself in the lower stream 81 by increasing the physical separation of these two streams. The mixing of the two streams can be substantially prevented by interposing the shield or separator wall 27 between the two streams. The heavier particles tend to fly off radially from the edge 76, while the smaller particles contained within the film on the rim tend to follow the rim downwardly and disengage only at the rim edge 79 under the separator wall 27.

Figure 7:
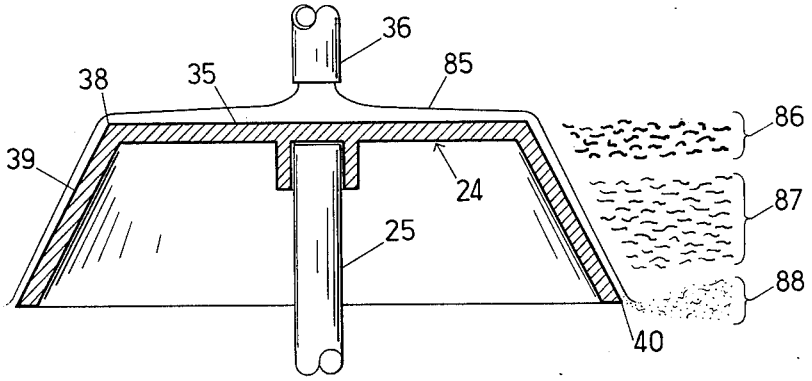
FIG. 7 is a simplified view of a rotating disk showing the relative positions of the particles of various sizes as they come off the disk.

The direction of the streams of particles or fibers 80 and 81 in FIG. 5 is only illustrative, since the actual mechanism of fiber or particle disengagement is somewhat more complicated. In FIG. 7, a disk, such as the disk 24 of FIG. 1, is shown with a film of slurry illustrated at 85 passing over its face surface 35 and rim 39. The very largest particles in the slurry—for example, clumps of fibers or shives and sand particles—will exit radially outward from the disk at the face edge 38 in a first stream portion 86. Many of the longer fibers, of greater fiber diameter, will also exit at about the edge 38, but, in addition, such long fibers will break free from the film on the rim surface 39 over a substantial portion of the length of the rim. Thus, a fairly diverse stream of longer fibers will be found exiting from the disk over a substantial portion of the length of the rim. The smallest fibers, those which cannot break the surface tension of the film, will exit more or less radially outward from the disk, along with the majority of the liquid in the film, at the rim edge 40 in a second distinct stream 88. Some of the longer, larger fibers may not initially have enough energy to break the surface of the film at the edge 38 when the film turns over the edge, but may acquire enough energy to overcome the surface tension in the film as the fibers move downward on the rim, and thereby outward. As the fibers move downward and thereby further away from the center of rotation, the momentum of the fibers increases; for the larger fibers this momentum may be sufficient to overcome the effect of surface tension within the film at some point on the rim below the face edge 38. The smaller fibers never acquire enough energy to break the film and are not ejected from the disk until the film itself is disengaged at the rim edge 40.

Figure 8:
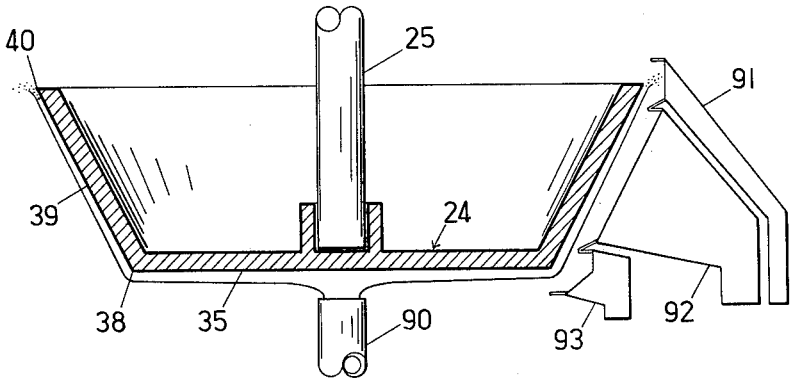
FIG. 8 is a simplified view of a bottom feed disk configuration.

The disks can also be operated in a feed configuration, illustrated in FIG. 8, wherein the particle suspension is forced up and supplied through a supply outlet 90 to the center of the face 35 of the disk 24 which, in this case, is rotated from the top by a shaft 25. The slurry clings to the surface of the disk in a film, moving over the edge 38 and onto the rim 39, and a fractionation of the particles within the slurry is achieved, but with the vertical order of the size of the particles being opposite to that shown in FIG. 7. The smallest particles and the majority of the liquid in the film are collected at the rim edge 40 in a first collector 91, the longer fibers which break the film as the film travels up the rim 39 may be collected in a second collector 92, and the largest particles, such as the shives and clumps, are collected at the face edge in another collector 93. Of course, these collectors preferably extend concentrically about the entire periphery of the disk.

Figure 9:
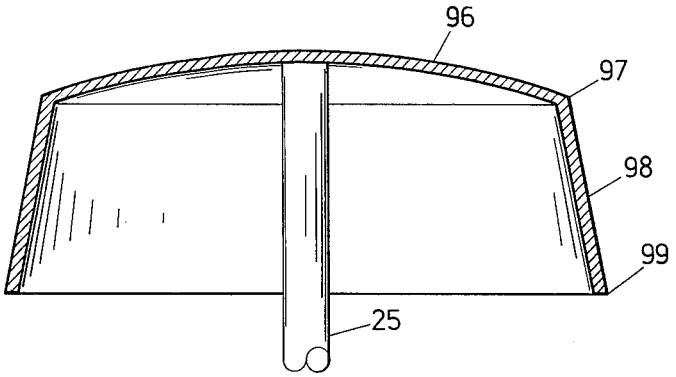
FIG. 9 is a simplified side view of another embodiment of a disk having a convex face surface.

The disks formed in accordance with the invention may have configurations other than the single flat face of the disks discussed above. The disk shown in FIG. 9 has a convex face 96 bounded by a circular peripheral face edge 97. A rim 98 extends downwardly and outwardly from the face edge 97 and terminates in a rim edge 99. In accordance with the design considerations noted above concerning the angle at which the rim extends away from the surface of the face, the disk of FIG. 9 is designed such that, at every point along the face edge 97, a plane tangent to the surface of the rim 98 intersects a plane tangent to the surface of the face 96 at such point along the rim 97 at an angle between them of at least 5° and preferably at least 20°. In addition, since the disk is rotated about a vertical axis of symmetry, the rim 98 intersects a horizontal plane (a plane perpendicular to the axis of rotation) at an angle of 90° or less.

Figure 10:
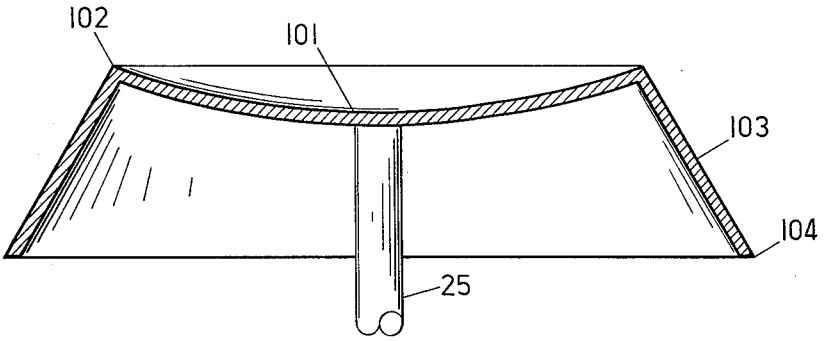
FIG. 10 is a simplified side view of another embodiment of a disk having a concave face surface.

An embodiment of a disk having a concave face 101 is shown in FIG. 10. The concave face 101 terminates in a peripheral face edge 102, and a rim 103 extends downwardly and outwardly from the edge 102 and terminates in a rim edge 104. Again, at every point along the peripheral face edge 102, a plane tangent to the rim surface 103 intersects a plane tangent to the face surface 101 at such point along the peripheral edge 22 at an angle of 20° or more; and the rim intersects a horizontal plane (a plane perpendicular to the axis of rotation) at an angle of 90° or less.

Figure 11:
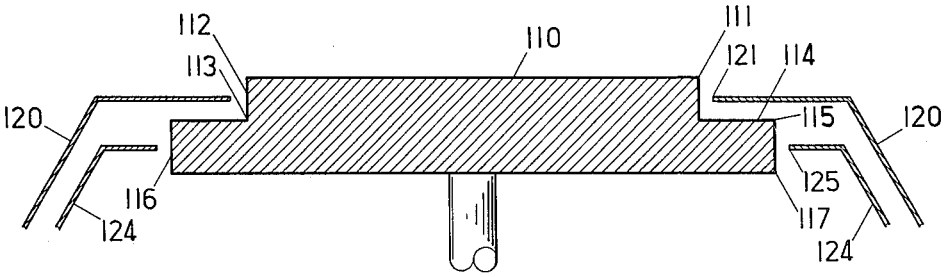
FIG. 11 is a simplified side view of another embodiment of a disk having a double face configuration.

Another disk embodiment is shown in FIG. 11 in which the disk has a double flat face. A first flat, circular face 110 terminates in a circular peripheral face edge 111. A cylindrical rim 112 extends downwardly from the face edge 111 and terminates at a rim edge or corner 113. However, a second peripheral face 114 extends outwardly from the circular rim edge 113. The second face 114 terminates in a second peripheral face edge 115, and a second cylindrical rim 116 extends downwardly from the face edge 115 and terminates in a second rim edge 117. The largest particles will be ejected from the disk at the first peripheral face edge 111 and will move substantially radially outward from the disk, while the smaller particles and the film will move over the edge 111 and down the rim 112, and will turn outwardly at the rim edge 113 and move over the surface of the second face 114. To segregate the particles which are ejected from the disk at the first face edge 111 from the film and the smaller particles carried in it, a circular separator wall or shield 120 is positioned with its circular inner edge 121 located close to the first rim 112 and spaced intermediate the first face edge 111 and the first rim edge 113. The length of the first rim 112 is selected such that the film will flow all the way down the rim without breaking free and will then flow over the face surface 114. It should be apparent that the particles that will tend to break free from the disk at the second face edge 115 will be smaller than those that break free from the first face edge 111; because the radius of the second face edge 115 is greater than the radius of the first face edge 111, the radial velocity of the particles within the film at the second face edge 115 will be greater than at the first face edge 111 and larger particles sill in the film will acquire enough momentum to break free from the film. Thus, a second separator 124 may be mounted with its inner edge 125 adjacent to the second rim 116 to separate the particles ejected from the second face edge 115 from the particles in the liquid film that remain on the second rim 116 and that eventually are ejected at the second rim edge 117. Although not shown, it is readily apparent that any number of additional concentric, outwardly extending faces could be added to the disk of FIG. 11 and additional separators used to separate ever finer particles from one another. Such use of a single disk to provide multiple fractions of particles or fibers within a slurry is an alternative to the use of multiple passes of a slurry through several disks having different designs and operated at different rotational speeds in order to achieve multiple fractionation. It is also apparent that the multiple face disks could have beveled rims and non-flat faces, as described above.

Practical limits on the size of a disk and the length of a beveled rim are imposed because the film on the surfaces of the disk will become unstable as the film moves sufficiently far away from the axis of rotation, under some conditions, portions of the film will break away from the surface of the rim before reaching the rim edge. The maximum speed of rotation and maximum length of the rim before onset of destructive instability can be determined experimentally and approximated by an analysis of the wave motion of the film as it moves over the rim.

In the examples below, fractionations with disks having varying dimensions and rotational speeds are illustrated.

EXAMPLES 1-3

Fractionation was carried out with a top feeding arrangement, such as illustrated in FIG. 1, on three sharp edged aluminum disks having, respectively, rim angles of 22.5°, 45°, and 67.5°. Each disk was formed as shown in FIG. 5, having a flat top face with a diameter of 6 inches and a rim length of 2 inches. The feed stock consisted of a mixture of rayon fibers of three different diameters, 3 denier (18.2 micron diameter), 5.5 denier (26 micron diameter) and 20 denier (54 micron diameter). The feed stock flow rate was maintained at about 3 liters per minute. The various disk were rotated at four progressively higher speeds: 1,910 rpm, 2,740 rpm, 4,200 rpm, and 6,000 rpm. Table 1 below shows the particular fiber size, if any, that was found to detach from the liquid film at the face edge of each disk.

TABLE 1

| Disk Rim Angle $\theta$ (Degrees) | Disk Speed (Rev./Min.) | | | |
|---|---|---|---|---|
| | 1,920 | 2,740 | 4,200 | 6,000 |
| 22.5 | None | None | None | 20D |
| 45 | None | None | 20D | 20D |
| 67.5 | None | 20D | 20D | 20D<br>5.5D |

In these tests, the flow rate was kept small so that the integrity of the film over the entire surface of the rim was maintained. The 20D (20 denier) fibers started to detach from the film at the face edge at 2,740 rpm for the disk with a 67.5° rim angle. As the disk speed was increased, the disengagement of 20D fibers occurred at smaller rim angles. The 5.5D fibers were observed to detach themselves from the film at a disk speed of 6,000 rpm and a rim angle of 67.5°. These results demonstrate that the detachment of fibers of ever smaller diameters will occur at the face edge as the disk speed is increased and the rim angle is increased as long as the integrity of the liquid film is maintained; that is, as long as the liquid film does not become unstable and begin to break away from the disk before reaching the rim edge.

The rate of flow of the slurry onto the top of the rotating disk can affect the stability of the film upon the disk and therefore the quality of the fractionation obtained. Experiments with the disk described in the example above which had a rim angle of 67.5° indicated that for flow rates of 0 to 4 liters per minute the characteristics of fractionation of a mixture of 3D and 20D rayon fibers showed no change at a rotational speed of 4,200 rpm. As the flow rate was increased beyond 4 liters per minute, the upper spray portion, such as the portion 80 illustrated in FIG. 5, which originally consisted of 20D fibers only, began to show traces of 3D fibers. This phenomenon occurred because the liquid film flowing over the face edge and the rim was no longer stable; instabilities in the film formed and broke off the surface of the rim in the form of ligaments and droplets. These instabilities in the film carried 3D fibers with them and consequently reduced the quality of the 20D fiber fraction. Aside from the break-up of ligaments on the rim surface, the liquid film also began to show instability while turning over the face edge. At about a flow rate of 4 liters per minute, a fraction of the liquid began to detach itself from the film while it turned the corner. The effect of flow rate on the stability of the film is illustrated below.

Water was supplied in a top feeding arrangement to three flat faced disks, of the type shown in FIG. 5, having rim angles of 22.5°, 45°, and 67.5°, and a critical flow rate was determined at which the film became unstable and a part of the film disengaged itself from the rim surface. The critical flow rates, in liters per minute, at which the disengagement of film occurs at various operating speeds is given in Table 2 below.

TABLE 2

| Disk Rim Angle $\theta$ (Degrees) | Disk Speed (Rev./Min.) | | |
|---|---|---|---|
| | 1,920 | 2,740 | 4,200 |
| 22.5 | 7.3 | 6.5 | 6.1 |
| 45 | 6.0 | 5.8 | 5.5 |
| 67.5 | 4.8 | 4.2 | 4.0 |

As discussed above, corrugated fiberboard pulp is made up of about $\frac{2}{3}$ "linerboard" and $\frac{1}{3}$ "medium" by weight, and thus contains fibers with diameters ranging from 10 to 60 microns and lengths ranging from 1 to 5 mm. If this fiberboard pulp were to be fractionated completely into "linerboard" and "medium" the cut or break off diameter should be about 30 microns and the corresponding fiber length would be about 2.5 mm. The fibers found in fiberboard pulp are not ideal cylindrical bodies but are at least partly ribbon shaped and thus do not follow exactly the theoretical predictions for fiber disengagement speeds and diameters as specified in the equations above which were derived for cylindrical fibers. Experimental results for fractionations of fiberboard pulp are set forth in the examples below.

EXAMPLES 4–18

A separator disk was set up in a bottom feed configuration of the type shown in FIG. 8. Three fractions discharged from the rotating disk were collected at locations shown in FIG. 8 in the collectors 91, 92, and 93. Sample 1, collected in the collector 91, contained the spray which was radially ejected at the rim edge. This fraction should consist of small fibers and fines accompanied by most of the feed water. Sample 2, collected by the collector 92, contained the fibers which were detached over the entire rim length. In theory, these fibers should be of larger diameter than the fines and should be unaccompanied by water as along as the film on the rim is stable over the length of the rim. Sample 3, collected in the collector 93, contained shives, large sand grains, and that portion of the water which was shed because of the instabilities originating at the disk face edge. Ideally, the flow rate should be low enough so that no detachment of the film occurs at the face edge. The samples were collected at about 1 inch from the surface of the rim in order to avoid any overlap of the spray zones.

For each test, the three fractions collected in the collectors 91–93 were analyzed for Canadian Standard Freeness (freeness) and fiber concentration. The feed pulp contained recycled corrugated fiberboard which had a freeness of 630 ml. The freeness of the "linerboard" by itself was known to be about 700 ml. and that of the "medium" was 480 ml.

The weight concentration of the fibers in the pulp slurry was determined by passing a selected amount of the original slurry through a course filter paper. The solids collected on the filter paper were then oven dried and weighed. The ratio of the weight of the oven dried solids to the total weight of the pulp slurry gave the fiber concentration in a given fraction.

The freeness of each sample was determined by thoroughly mixing 1 liter of sample at 0.3% consistency at 20° C. and placing the mixed sample into the top container of the freeness tester. The valve at the bottom of this container was then opened and the pulp allowed to flow through a funnel into a bottom container. The overflow from the funnel was collected into a measuring cylinder. The amount of pulp slurry collected in the measuring cylinder as an overflow depended on how fast the pulp sample drained out of the top cylinder. This overflow volume is defined as the freeness of the pulp. If the pulp samples contained small fibers and fines they would tend to block the screen in the top container very readily; this would reduce the overflow from the funnel and thus the freeness value would be very small, for example, on the order of 50 ml. However, if the pulp contained course fibers, the resistance to water flow from the top container would be minimal. This would result in a large overflow and therefore the freeness would be very high, for example, on the order of 700 ml.

In order to measure quantitatively the extent of fractionation, the following method was used. Letting $f_i$ be the freeness value of a sample i (sample Nos. 1, 2, or 3, from collectors 91, 92, and 93, respectively) for which the weight fraction of solids is $X_i$, then the average freeness value for a set of N samples is given by $$\bar{f}=\Sigma x_i f_i$$

The extent of fractionation ΔF, a measure of the difference in freeness between the samples, is defined as $$\Delta F=[\Sigma x_i(f_i-\bar{f})^2]^{\frac{1}{2}}$$

The results of fractionations obtained with 3 different disk designs at various disk speeds is given below in Table 3.

TABLE 3

| Disk speed rev/min | Flow rate gal/min | Feed concentration, percent wt. | Sample No. | Fraction Properties: Wt. fraction percent | Freeness | Fiber concentration, percent wt. | Extent of Fractionation ΔF, ml. |
|---|---|---|---|---|---|---|---|
| Disk Design: 6-in diameter flat face, rim angle 22½ degrees, rim length 2 in. | | | | | | | |
| 3,159 | 5.0 | 3.2 | 1 | 52.6 | 485 | 2.2 | 70.0 |
| | | | 2 | 47.4 | 625 | 4.0 | |
| | | | 3 | — | — | — | |
| | 2.0 | 3.2 | 1 | 44.0 | 410 | 1.4 | 116.0 |
| | | | 2 | 17.6 | 625 | 1.9 | |
| | | | 3 | 38.4 | 650 | 3.3 | |
| 6,800 | 3.3 | 3.2 | 1 | 28.0 | 440 | 1.4 | 87.5 |
| | | | 2 | 19.0 | 635 | 2.1 | |
| | | | 3 | 53.0 | 630 | 3.1 | |
| | 4.3 | 1.6 | 1 | 27.0 | 500 | 1.1 | 67.0 |
| | | | 2 | 24.0 | 640 | 2.0 | |
| | | | 3 | 49.0 | 665 | 1.9 | |
| | 3.3 | 0.8 | 1 | 24.0 | 485 | 0.4 | 90.0 |
| | | | 2 | 57.0 | 695 | 1.6 | |
| | | | 3 | 19.0 | 660 | 0.9 | |
| 9,000 | 5.1 | 0.8 | 1 | 18.2 | 465 | 0.4 | 100.0 |
| | | | 2 | 67.7 | 725 | 1.5 | |
| | | | 3 | 14.1 | 650 | 0.9 | |
| 12,400 | 3.4 | 0.8 | 1 | 4.4 | 115 | 0.2 | 120.0 |
| | | | 2 | 32.9 | 650 | 1.6 | |
| | | | 3 | 62.6 | 705 | 1.4 | |
| Disk Design: 6-in. diameter flat face, rim angle 45 degrees, rim length 2 in. | | | | | | | |
| 3,159 | 2.7 | 3.2 | 1 | 18.2 | 345 | 1.0 | 107.0 |
| | | | 2 | 49.7 | 600 | 2.7 | |
| | | | 3 | 32.1 | 645 | 3.0 | |
| 6,800 | 3.4 | 3.2 | 1 | 7.9 | 85 | 0.8 | 154.0 |
| | | | 2 | 32.7 | 585 | 2.4 | |
| | | | 3 | 59.4 | 660 | 3.0 | |
| 9,000 | 3.4 | 0.8 | 1 | 13.4 | 495 | 0.7 | 67.3 |
| | | | 2 | 73.7 | 695 | 1.2 | |
| | | | 3 | 13.0 | 665 | 0.8 | |
| 12,400 | 6.8 | 0.8 | 1 | 13.5 | 350 | 0.4 | 118.6 |
| | | | 2 | 74.6 | 700 | 1.5 | |
| | | | 3 | 11.9 | 670 | 0.9 | |
| Disk Design: 6-in. diameter flat face, rim angle 67.5 degrees, rim length 2 in. | | | | | | | |
| 6,800 | 3.4 | 0.8 | 1 | 0.9 | 65 | 0.12 | 72.2 |
| | | | 2 | 48.4 | 630 | 0.69 | |
| | | | 3 | 50.7 | 700 | 1.2 | |
| 9,000 | 3.4 | 0.8 | 1 | 2.6 | 215 | 0.25 | 74.1 |
| | | | 2 | 43.1 | 640 | 0.73 | |
| | | | 3 | 54.3 | 705 | 1.5 | |
| 9,000 | 4.6 | 0.8 | 1 | 5.9 | 425 | 0.21 | 65.2 |
| | | | 2 | 48.7 | 670 | 1.23 | |
| | | | 3 | 45.4 | 710 | 1.25 | |
| 12,400 | 3.2 | 0.8 | 1 | 6.0 | 160 | 0.28 | 131.2 |
| | | | 2 | 22.3 | 580 | 0.59 | |
| | | | 3 | 71.8 | 700 | 1.43 | |

It is clear from an examination of the data in the tables that the properties of the various fractions are in agreement with the predictions. For each run, the fractions in samples 2 and 3 had larger freeness values than sample 1, which indicated that large fibers were contained in samples 2 and 3 while the small fibers and fines were contained in sample 1. The fiber concentrations in samples 2 and 3 were greater than that in the feed mixture and indicated a certain amount of dewatering. The fiber concentration in sample 1 was much less than that in the feed pulp slurry and indicated that much of the water is ejected only at the rim edge.

The conditions required for fractionation of fibers which differ in diameter can be summarized in accordance with the embodiments of the invention set forth above. The surface of the disk in contact with the film of slurry must be highly wettable by the slurry liquid, the face surface of the disk must be large enough such that sufficient momentum is provided to fibers at the disk edge to allow escape of some of the fibers to occur at the edge, and the face edge itself must be relatively sharp rather than smooth or curved. The rim surface must have sufficient length to allow ejection of the majority of the larger diameter fibers, the rim angle, the angle between the intersection of planes tangent to the rim surface and the face surface at the face edge, must be greater than 0 degrees, 5° generally being the minimum practical and at least 20° being preferred; and the angle between a plane perpendicular to the axis of rotation of the disk and the rim surface must be between 0 and 90 degrees. The face and rim surfaces must be adapted to form a stable film of the slurry thereon. A smooth, wettable metal surface is so adapted under the conditions described in the examples above. Other surface characteristics may be provided to the face and rim to best stabilize the slurry film in accordance with fluid mechanics practice.

Fiber fractionation or separation occurs shortly beyond the face edge. Because of surface wetting, the fast and radially moving liquid film turns over the face edge and travels along the rim for some distance before being disengaged. Inertial effects which result from this sudden change in the liquid film's direction of flow cause migration of fibers toward the surface of the film. Fibers which possess enough kinetic energy to overcome surface forces are disengaged from the film whereas those which do not possess enough kinetic energy are trapped within the film and carried to the rim edge. The spray emanating from the disk is, under preferred conditions, composed of two separate zones: one containing large diameter dewatered fibers which are able to disengage from the liquid film, and the other containing small fibers and most of the liquid which is disengaged from the rim surface only at the rim edge. The fractions are preferably collected very close to the rim surface to avoid overlap of these zones.

It should be apparent that, while the above described fractions were carried out with fiber slurries, similar separations can be obtained with various types of homogeneous or heterogeneous slurries of solid particles, including agglomerates and fibriles.

While specific embodiments of the invention have been disclosed and described herein, the invention is not so limited, but rather embraces the modified forms thereof that come within the scope of the following claims.

What is claimed is:

1. Apparatus for fractionating a mixture of particle of different sizes suspended in a liquid to produce at least two portions of particles separated by size, comprising:

(a) a disk symmetrical about an axis, having a face surface terminating in a sharp, circular edge, a rim extending away from the face edge such that at the face edge a plane tangent to the surface of the rim intersects a plane tangent to the surface of the face at an angle of about 20° or more, and the rim intersects a plane perpendicular to the axis of symmetry of the disk at an angle of 90° or less, the rim terminating in a rim edge with the length of the rim between the face edge and the rim edge being sufficient to allow a suspension of particles and liquid to turn over the face edge and form a film on the rim, the face and rim surfaces being adapted to allow a stable film of the liquid carrying the particles to form thereon;

(b) means for rotating the disk about its axis of symmetry;

(c) a supply outlet mounted such that a mixture of particles in suspension in a liquid can be supplied therethrough onto the disk face; and (d) a separator wall mounted to separate material ejected in a first stream radially outward from the face edge of the disk from material ejected in a second stream from the rim of the disk, the separator wall having an inner edge closely adjacent to the rim of the disk and at a position intermediate the face edge and the rim edge to thereby physically separate the first and second streams so that they do not substantially mix.

2. The apparatus of claim 1 including enclosure walls surrounding the disk and the separator wall and wherein the separator wall defines, with the enclosure walls, two chambers, one chamber collecting material discharged radially outward from the face edge of the disk in the first stream and the other chamber collecting material discharged in the first stream at an angle to a horizontal plane perpendicular to the axis of symmetry of the disk.

3. The apparatus of claim 1 wherein the face surface of the disk is flat and horizontal and the rim extends downwardly from the face.

4. The apparatus of claim 1 wherein the face surface is flat and horizontal and the rim extends upwardly from the face.

5. The apparatus of claim 1 wherein the surface of the rim of the disk has the shape of a frustum of a cone and intersects a plane perpendicular to the axis of symmetry of the disk at an angle between approximately 22° and 68°.

6. The apparatus of claim 1 or 5 wherein the face surface is flat and the length of the rim between the face edge and the rim edge is at least ⅜ inch.

7. The apparatus of claim 6 wherein the face of the disk is approximately 6 inches in diameter.

8. The apparatus of claim 1 wherein the length of the rim between the face edge and the rim edge is about 2 inches.

9. The apparatus of claim 1 wherein the face surface is convex.

10. The apparatus of claim 1 wherein the face surface is concave.

11. The apparatus of claim 1 wherein the means for rotating the disk is attached to the side of the disk opposite the disk face.

12. Apparatus for fractionating a mixture of particles of different sizes suspended in a liquid to produce at least two portions of particles separated according to size, comprising:

(a) a disk symmetrical about an axis of symmetry, the disk having a flat face which is smooth and wettable, a sharp, circular edge bounding the face, and a smooth, wettable rim extending away from the face edge and terminating at a rim edge, the rim intersecting the plane of the face at an angle between 90° and 5°;

(b) means for rotating the disk about its axis of symmtry;

(c) a supply outlet mounted such that a mixture of particles in suspension in a liquid can be supplied therethrough onto the disk face;

(d) a collector having at least two compartments positioned to collect spray from the disk at two separate elevations with respect to the disk, one collector compartment positioned to receive the portion of the spray containing course materials above a selected size, and the other compartment positioned to receive the portion of the spray containing the major portion of the liquid carrier and the fine particles smaller than the selected size.

13. The apparatus of claim 12 including enclosure walls around the disk to confine all of the spray from the disk.

14. The apparatus of claim 12 wherein the disk has a rim at least ⅜ inch long which extends downwardly from the face edge of the disk at an angle with respect to the face surface of 90°.

15. The apparatus of claim 12 wherein the disk has a rim at least ⅜ inch long formed in the shape of a frustum of a cone with the surface of the rim intersecting the plane of the face surface at an angle between approximately 22° and 68°.

16. The apparatus of claim 12 wherein the disk has a rim having the shape of a frustum of a cone which extends downwardly from the face edge and has a length between the face edge and the rim edge of at least 2 inches and less than 4 inches and which forms an angle with respect to the plane of the face surface between approximately 22° and 68°.

17. The apparatus of claim 15 or 16 wherein the diameter of the face surface is approximately 6 inches.

18. The apparatus of claim 12 wherein the means for rotating the disk is attached to the side of the disk opposite the disk face.

19. The apparatus of claim 18 wherein the means for rotating the disk includes an electrical drive motor having a drive shaft extending therefrom and attached to the side of the disk opposite the face to support the disk for rotation.

20. The apparatus of claim 12 wherein the compartments of the collector are separated by a separator plate having an inner edge which is mounted adjacent to the rim of the disk intermediate the face edge and the rim edge.

21. The apparatus of claim 12 wherein the collector includes a plurality of compartments mounted in ascending vertical arrangement to collect the spray from the rotating disk at a plurality of heights, including a position directly radially outward from the face edge of the rotating disk and a position directly radially outward from the rim edge of the disk.

22. A method of separating particles by size from a mixture of particles of various diameters which are suspended in a liquid, comprising the steps of:

(a) rotating a disk about its axis of symmetry, the disk having a face surface terminating in a sharp peripheral face edge and a rim at least ⅜ inch long extending away from the face edge and terminating in a rim edge, the rim surface intersecting a plane perpendicular to the axis of rotation of the disk at an angle between approximately 5° and 90°;

(b) supplying a suspension of particles in liquid to the face of the disk, the suspension containing a mixture of particles having diameters less than and greater than a selected break point diameter;

(c) selecting the speed of rotation of the disk to be sufficient to result in particles having a diameter greater than the break point diameter being ejected from the disk at the face edge while particles below the break point diameter are carried with the liquid over the face edge and onto the rim, and selecting the rate of flow of the liquid suspension to the face such that a stable film of the liquid suspension is formed on the face surface and rim surface; and (d) collecting the material that is discharged directly radially outward from the face edge and separately collecting the material that is discharged outwardly from the rim of the disk.

23. The method of claim 22 wherein the suspension of particles in liquid supplied to the disk is a suspension of fibers in water, the fibers comprising a mixture of fibers of different diameters, the speed of rotation of the disk and the rate of flow of the suspension being selected to provide separation of the fibers about a chosen fiber diameter.

24. A method of separating particles of differing sizes which are contained in a liquid carrier, comprising the steps of:

(a) rotating a disk about a vertical axis, the disk having a flat face surface, a sharp, circular peripheral face edge defining the boundary of the face surface, and a rim extending away from the face edge at an angle between approximately 90° and 20° with respect to the plane of the face surface and terminating in a rim edge;

(b) supplying a mixture of particles of differing sizes in a liquid carrier to the face of the rotating disk;

(c) collecting the spray from the rotating disk which is impelled substantially radially from the face edge, such portion of the spray containing primarily course particles above a size selected for separation; and (d) collecting the spray impelled outwardly from the rim and which is separated by a vertical distance from the portion of the spray which is directed radially from the face edge, such portion of the spray containing primarily the liquid carrier and the fine particles which are below the size selected for separation.

25. The method of claim 24 wherein the particles are fibers of differing diameters suspended in water.

26. Apparatus adapted for use in separating particles in liquid suspension by size, comprising:

(a) a disk symmetrical about an axis of symmetry, the disk having a flat face on one side which is smooth and wettable, a sharp, circular edge bounding the face, and a smooth, wettable rim extending away from the face edge and terminating at a rim edge, the length of the rim from face edge to rim edge being at least $\frac{3}{8}$ inch and the rim interecting the plane of the face at an angle between 90° and 5°; and (b) means attached to the disk on the side thereof opposite to the face for rotating the disk about its axis of symmetry.

27. The apparatus of claim 26 wherein the rim intersects the face at an angle between approximately 22° and 68°.

28. The apparatus of claim 27 wherein the rim is between about two to four inches long.

* * * * *